US007541746B2

(12) United States Patent
Pruett

(10) Patent No.: US 7,541,746 B2
(45) Date of Patent: Jun. 2, 2009

(54) LAMP DRIVER CIRCUIT WITH POWER FACTOR CORRECTION CIRCUIT COUPLED TO DIRECT-CURRENT TO DIRECT-CURRENT POWER CONVERTER

(75) Inventor: H. Frazier Pruett, Mulino, OR (US)

(73) Assignee: InFocus Corporation, Wilsonville, OR (US)

( * ) Notice: Subject to any disclaimer, the term of this patent is extended or adjusted under 35 U.S.C. 154(b) by 81 days.

(21) Appl. No.: 11/228,373

(22) Filed: Sep. 15, 2005

(65) Prior Publication Data

US 2007/0057642 A1 Mar. 15, 2007

(51) Int. Cl.
*H05B 41/16* (2006.01)

(52) U.S. Cl. ..... 315/247; 315/291; 315/307; 315/224; 315/274

(58) Field of Classification Search ..... 315/247, 315/246, 291, 307, 297, 279, 278, 276, 277, 315/274, 209 R, 200 R, 224, 225
See application file for complete search history.

(56) References Cited

U.S. PATENT DOCUMENTS 5,866,993 A * 2/1999 Moisin ..... 315/307
6,091,612 A * 7/2000 Blankenship ..... 363/45
6,433,493 B1 * 8/2002 Ilyes et al. ..... 315/291
6,624,585 B2 9/2003 Pruett ..... 315/151
6,700,335 B2 * 3/2004 Prasad ..... 315/307
6,781,323 B1 * 8/2004 Ching-Ho et al. ..... 315/247
6,784,622 B2 * 8/2004 Newman et al. ..... 315/219
6,909,622 B2 * 6/2005 Weng ..... 363/126
2002/0033679 A1 * 3/2002 Hui et al. ..... 315/307
2003/0227784 A1 * 12/2003 Qiao et al. ..... 363/21.14
2004/0085788 A1 * 5/2004 Weng ..... 363/126

OTHER PUBLICATIONS

ISA U.S., International Search Report of PCT/US2006/032340, Mar. 27, 2008, WIPO.

* cited by examiner

*Primary Examiner*—Tuyet Vo
(74) *Attorney, Agent, or Firm*—Alleman Hall McCoy Russell & Tuttle LLP

(57) ABSTRACT

A lamp driver circuit is disclosed. The lamp driver circuit comprises a passive power factor correction (PFC) circuit. The passive PFC circuit, in operation, is coupled with an alternating-current (AC) power source. The lamp driver circuit further includes a direct-current to direct-current (DC-DC) power converter coupled with the passive PFC circuit. The DC-DC power converter, in conjunction with the passive PFC circuit, operates as a constant energy converter. The lamp driver circuit also includes a lamp circuit coupled with the DC-DC power converter.

14 Claims, 5 Drawing Sheets

LAMP DRIVER CIRCUIT WITH POWER FACTOR CORRECTION CIRCUIT COUPLED TO DIRECT-CURRENT TO DIRECT-CURRENT POWER CONVERTER

BACKGROUND

I. Field

This disclosure is related to power supply circuits for powering lamp bulbs.

II. Description of Related Art

Display technology (e.g., for use in computer and entertainment display devices) continues to advance, as generally is the case with consumer and business electronics. Display devices (such as digital display projectors, flat panel displays, plasma displays, cathode-ray-tube (CRT) displays, etc.) continue to improve in the quality and resolution of the images they display. A wide variety of such display systems are available from InFocus Corporation of Wilsonville, Oreg., the assignee of the present application.

Projection display devices, such as those manufactured by InFocus, include an optical subsystem for displaying images (e.g., still images or video). Such optical subsystems typically include an illumination source (e.g., a high pressure mercury lamp) for generating light to project such images. The illumination source (lamp) is powered (driven) by a lamp driver circuit. Current lamp driver circuits have certain drawbacks, however.

One drawback of current lamp driver circuits is that a tradeoff is made in their design process due, in part, to that fact that most lamp bulbs (lamps) currently used in displayed devices are short arc lamps. In order to improve the life of such lamps, it is desirable that the output capacitors of the lamp driver circuit used to drive the lamp be relatively small in order to reduce the amount of transient current that is delivered to the lamp from the driver circuit. However, the amount of ripple current (e.g., resulting from conversion of alternating current power to direct current power) should also be reduced to prevent arc jump (which may damage the lamp) and flicker (which may adversely effect the quality of projected images). Current approaches use passive and inductive filtering to reduce ripple current. The use of such filtering conflicts with the goal of reducing the size of the lamp driver circuit's output capacitors. Therefore, in such approaches, a trade off is typically made between reducing ripple current and reducing the size of the lamp driver circuit output capacitors.

Another drawback of current lamp driver circuits is the overall cost of such circuits. Current approaches for implementing lamp driver circuits utilize two active converters, a front end converter, which may be termed a power factor converter, and a back end converter, which converts the power provided by the front end converter to power (typically direct-current (DC) power) that is usable for illuminating (driving) the lamp. A typical configuration of a current lamp driver circuit includes a boost converter for the front end converter that both rectifies power from an alternating-current (AC) power source (e.g., 120V residential AC power) and steps-up that rectified power to a high voltage (e.g., 400-500V) in order to adjust the power factor (e.g., the strain on the AC power source) and/or adjust the effective power consumption of the lamp driver circuit.

In such a configuration, the back-end converter is typically implemented as a buck converter that steps down the high voltage produced by the front-end converter to a voltage that is usable by the lamp (e.g., 40-50V). Because the front-end converter and back-end converter are both active circuits that include active components and control circuits (e.g., pulse-width modulation controllers), such approaches may be expensive. Further, such approaches also suffer from the trade off between reducing output capacitor size and the reduction of ripple current. Based on the foregoing, alternative approaches for implementing lamp driver circuits are desirable.

The foregoing examples of the related art and limitations related therewith are intended to be illustrative and not exclusive. Other limitations of the related art will become apparent to those of skill in the art upon a reading of the specification and a study of the drawings.

BRIEF DESCRIPTION OF THE DRAWINGS

Example embodiments are illustrated in referenced figures of the drawings. It is intended that the embodiments and figures disclosed herein are to be considered illustrative rather than restrictive.

DETAILED DESCRIPTION

Lamp Driver Circuit

Figure 1:
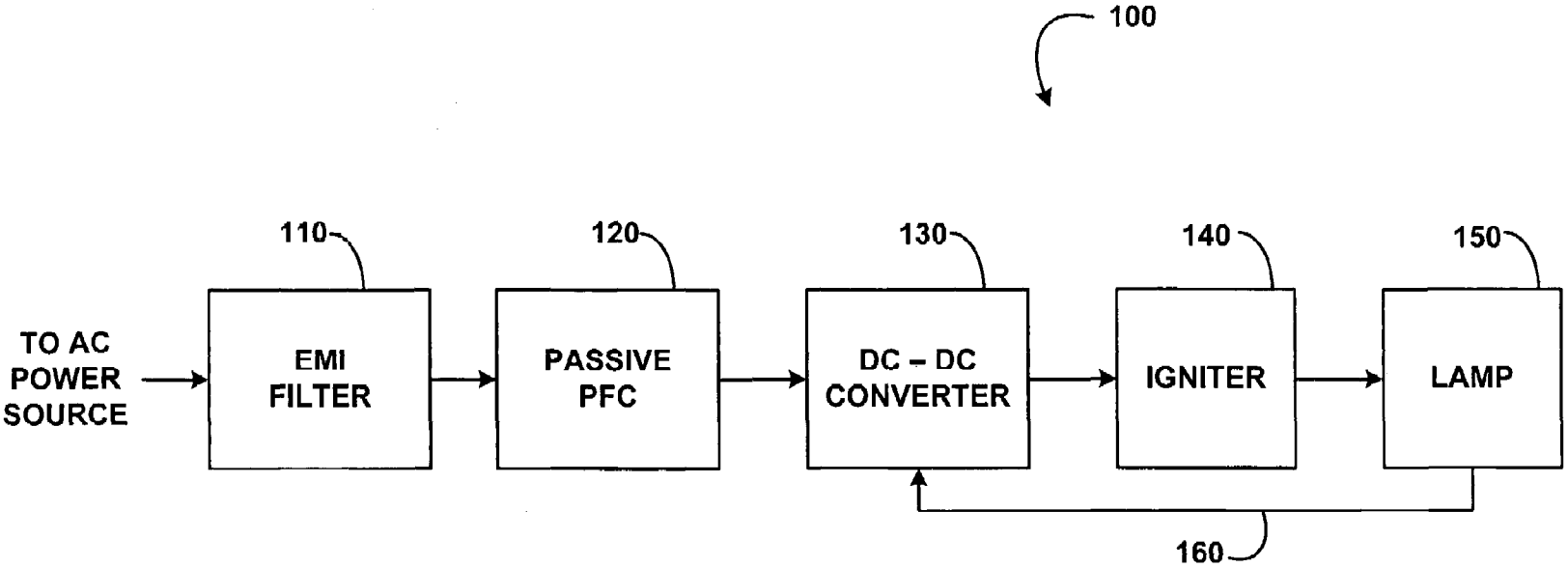
FIG. 1 is a block diagram of a lamp driver circuit.

Referring now to FIG. 1, a block diagram of a lamp driver circuit 100 that addresses at least some of the drawbacks of current approaches that were described above is illustrated. The lamp driver circuit 100 includes an electromagnetic-interference (EMI) filter 110 that, in operation, is coupled with an alternating-current (AC) power source, as is shown in FIG. 1. The EMI filter 110 is used to reduce noise, such as high-frequency noise, that may be generated by the lamp driver circuit 100. The EMI filter 110 prevents such noise from being transmitted onto the power line. This filtering is desirable as such noise may interfere with the operation of other electrical devices connected to the same power line.

The AC power source may be a 120V AC power source, as is prevalently used in the United States. Alternatively, the AC power source may be a 240V AC power source, as is prevalently used in European countries. Of course, any appropriate power source may be used.

The lamp driver circuit 100 further includes a passive power factor correction (PFC) circuit 120 that is coupled with the EMI filter 110. Depending on the particular embodiment, the passive PFC circuit 120 may rectify a filtered AC power signal that is received from the EMI filter 110, store electrical energy from the rectified signal and deliver that stored electrical energy to other portions of the lamp driver circuit 100. Further, the circuit elements of the passive PFC circuit 120 are selected so that an appropriate power factor correction is made for the particular application (e.g., to adjust the strain on the power coupling and/or adjust the effective power consumption of the lamp driver circuit as appropriate).

Because the PFC circuit 120 is a passive circuit (e.g., contains no active elements and/or controller), it would generally be much less expensive to implement than an active front-end converter that contains active elements and/or controllers (e.g., pulse-width-modulation controllers), such as are used in current lamp driver circuits. Therefore, the use of the passive PFC circuit 120 may provide a cost advantage over current approaches.

The passive PFC circuit 120 is coupled with a DC-DC converter 130. For this embodiment, the DC-DC converter 130 receives a filtered, rectified DC power signal from the passive PFC circuit 120. The DC-DC converter 130 then converts that filtered, rectified DC power signal into a DC power signal that is suitable for use in driving (powering) a lamp bulb. Depending on the particular application, the DC-DC converter may step-down (e.g., operate as a buck converter) or step-up (e.g., operate as a boost converter) the filtered, rectified DC power signal received from the passive PFC circuit 120. The particular approach may depend on a number of factors such as, but not limited to, the AC power source used, the desired power factor and/or the power requirements of the lamp being used.

The DC-DC converter 130 operates discontinuously at a fixed frequency, so as to operate as a constant energy converter. For example, for the circuit 100, the DC-DC converter 130 draws power directly from the AC line for a substantial portion of the AC input waveform cycle when the line voltage is above a threshold (e.g., 150 degrees out of 180). In this situation, the DC-DC converter then draws power from the Passive PFC circuit 120 for the remainder of the AC input waveform cycle (e.g., 30 degrees of 180). At the end of each switching cycle of the DC-DC converter 130 (when operating directly from the AC line voltage or energy stored in the passive PFC circuit 120) there is essentially no energy stored in the DC-DC converter. Such an approach allows for a reduction in the energy stored per line cycle of the AC input waveform. In such an arrangement, the threshold voltage may be selected to be one-half of the nominal peak line voltage of the AC power source, for example.

The approach described above results in the voltage presented to the DC-DC converter 130 having a relatively large line frequency component (e.g., 50%), which results in a ripple current. However, because the DC-DC converter 130, in conjunction with the passive PFC converter 120, is operated as a constant energy converter, line frequency ripple current is reduced by what may be termed "rejection." By storing a substantially fixed amount energy in one portion of a period at which the lamp driver circuit is operated (for each period) and delivering that fixed amount of energy (for each period) in a second portion of the lamp driver circuit period, the ripple current is effectively "rejected" in that it is not substantially communicated to the output terminals of the DC converter. Therefore, such an approach allows for a larger line frequency ripple component to be present in the converter, as such a constant energy conversion approach has inherent voltage rejection characteristics.

The lamp driver circuit 100 also includes a lamp igniter 140 that is coupled with the DC-DC converter 130. The igniter circuit 140 generates an electric discharge at a sufficiently high voltage in order ionize gas that is present in a short arc lamp bulb 150, which is also coupled with the igniter 140. The igniter 140 operates to ionize the gas in the lamp bulb 150 when the bulb is initially turned on. Once the bulb 150 is illuminated, the DC-DC converter provides the necessary power (e.g., via the igniter circuit) to maintain illumination of the bulb. Such an igniter circuit is described in U.S. Pat. No. 6,624,585, which is assigned to the assignee of the present invention. The entire disclosure of U.S. Pat. No. 6,624,585 is incorporated by reference herein in its entirety.

The lamp driver circuit 100 further includes a lamp return signal line 160, which couples the lamp bulb 150 with the DC-DC converter 130. The lamp return signal line 160 may be used for power monitoring and/or power regulation. For example, the lamp return signal line 160 may be used for measuring a voltage drop across the lamp bulb 150 (lamp voltage) and/or the amount current being dissipated in the lamp bulb 150 (lamp current). Depending on the particular embodiment, additional circuitry may be used to determine the lamp voltage and/or lamp current.

Passive Power Factor Correction Circuit

Figure 2:
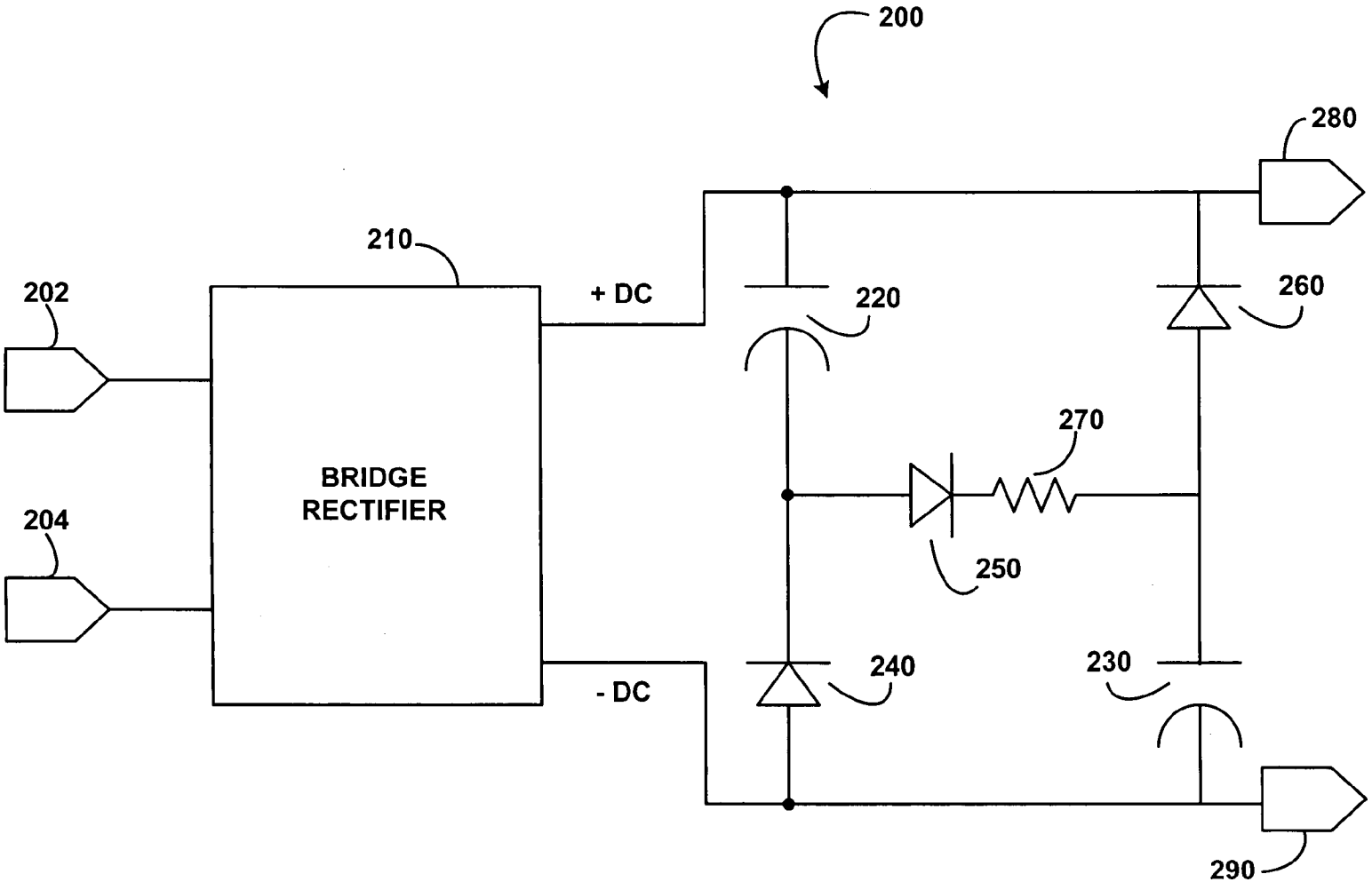
FIG. 2 is a block/schematic diagram of a passive power factor correction circuit that may be implemented in the circuit of FIG. 1.

Referring now to FIG. 2, a block/schematic diagram of a passive PFC circuit 200 that may be implemented as the passive PFC circuit 120 in the lamp driver circuit 100 is illustrated. The passive PFC circuit 200, which may be termed a valley-fill circuit, includes input terminals 202 and 204. The input terminals 202 and 204, in operation, receive an AC power signal (e.g., a filtered power signal from an EMI filter). This AC power signal is then communicated to a bridge rectifier circuit, which rectifies the AC power signal. Such circuits are known and will not be described in detail here for the purposes of brevity and clarity.

The passive PFC circuit 200 further includes capacitors 220 and 230; diodes 240, 250 and 260; resistor 270; and output terminals 280 and 290. The passive PFC circuit 200 operates such that the capacitors 220 and 240 are charged in series through diode 250 and resistor 270 when the rectified DC voltage is above one-half of the peak AC voltage received at the input terminals 202 and 204 (e.g., approximately one-half of the nominal peak line voltage of the AC power source). The resistor 270 acts as current limiter device to limit the amount of transient current through the capacitors 220 and 240, as well as establishing a suitable charging time constant.

The power stored in the capacitors 220 and 230 is then delivered (in parallel through diodes 240 and 260, respectively) to a DC-DC converter via the output terminals 280 and 290 when the rectified DC voltage is below one-half of the peak AC voltage received at the input terminals 202 and 204. Appropriate circuitry for controlling the flow of current between the passive PFC circuit 200 and a DC-DC converter in a lamp driver circuit would also be typically implemented. Such circuitry may include a transistor switch, a current blocking diode, or any other suitable approach for directing the flow of current in such circuits.

Buck-Boost DC-DC Converter

Figure 3:
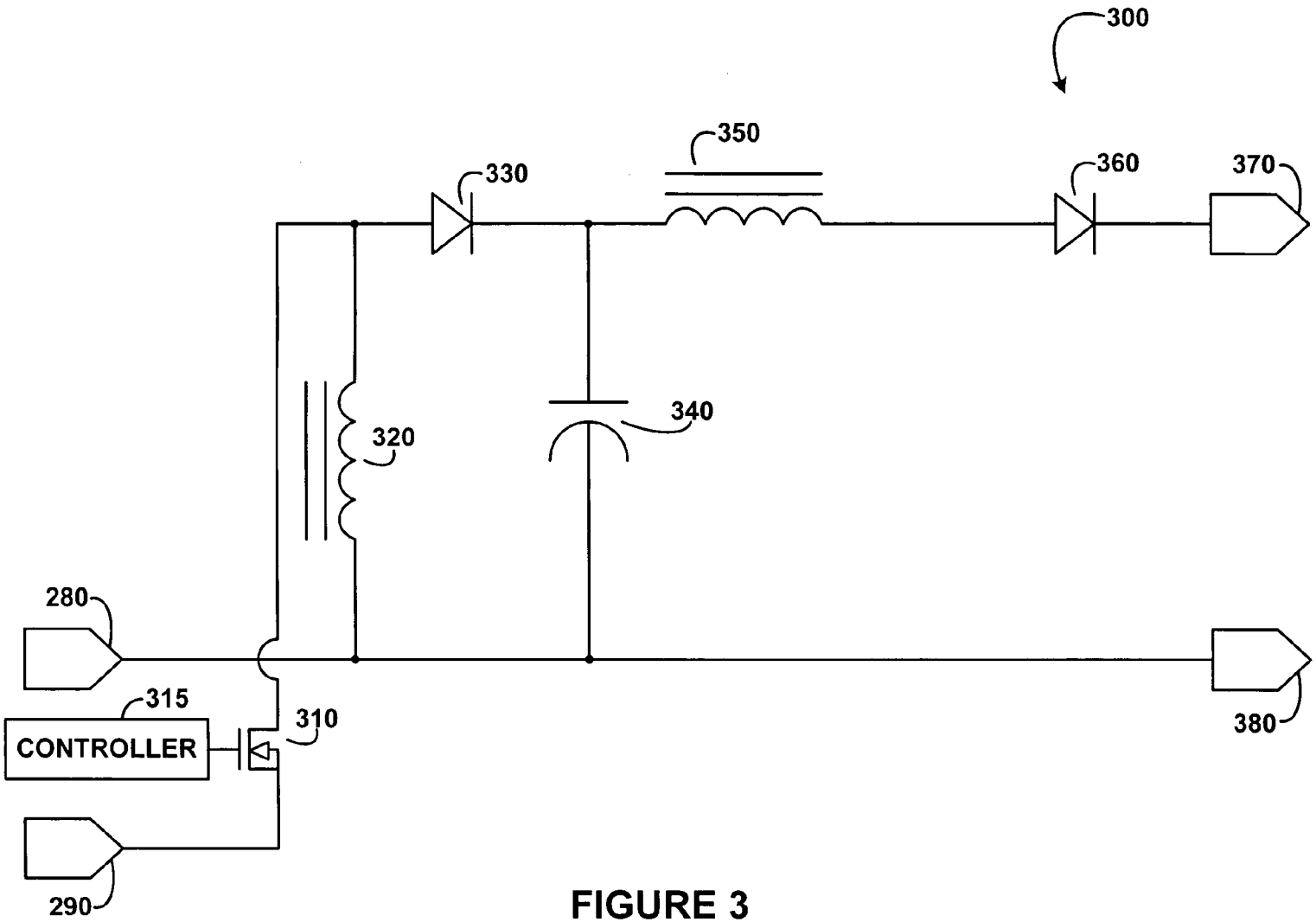
FIG. 3 is a schematic diagram of a buck-boost direct-current to direct-current (DC-DC) converter that may be implemented in the circuit of FIG. 1.

Referring now to FIG. 3, a schematic diagram illustrating a buck-boost converter 300 that may be implemented as the DC-DC converter 130 of the lamp driver circuit 100 is illustrated. As shown in FIG. 3, the output terminals 280 and 290 of the passive PFC circuit 200 act as input terminals for the buck-boost converter 300. That is, the power delivered from the passive PFC circuit 200 is communicated to the buck-boost converter 300 via the terminal 280 and 290.

The buck-boost converter 300 includes an n-type field-effect transistor (FET) 310 that acts as a switching element to control the DC-DC power conversion performed by the buck-boost converter 300. It will be appreciated that other switching elements may be used, such as a bipolar transistor or an insulated gate bipolar transistor, as two examples. The gate (e.g., the controlling terminal) of the transistor (switch) 310 is coupled with a controller 315, such a PWM controller. When the transistor 310 is turned on, electrical energy is stored in an inductor 320 as a result of current flow from the terminal 280 through the inductor 320 and further through the transistor 310 to terminal 290. When the transistor 310 is off (and the inductor 320 is charged with a sufficient potential) diodes 330 and 360 become forward biased power is delivered to a lamp circuit (e.g., an igniter and a lamp bulb) via the output terminal 380. This output power is filtered with an output capacitor 340 and an output inductor 350. As was previously discussed, by operating the passive PFC control circuit 200 and the DC-DC converter 300 discontinuously, ripple current is rejected This approach allows for a reduction in the size of the output capacitor 340 as compared with prior approaches.

To operate the lamp driver circuit discontinuously, the DC-DC converter 300 is arranged such that there is substantially no stored electrical energy left stored in the inductor 320 at the end of the switching period. For the purpose of this disclosure, discontinuous operation refers to the DC-DC converter 300 and not to the passive PFC. The controller 315 sets the peak current level in the inductor. Because the energy stored in the inductor 320 is related to its inductance (L) times the square of the current (I) as L×I^2 through the inductor 320, the peak current established by the controller 315 also determines the energy stored in the inductor 320 per switching cycle.

To control the energy stored per switching cycle for the DC-DC converter 300, the transistor 310 "on-time" is slaved to the peak current by the controller 315. Accordingly, the time the transistor 310 is on per switching cycle is directly related to the applied voltage. Thus, for input voltages that are in such a range that allows for discontinuous operation for a particular DC-DC converter 300 configuration, variations in the input voltage presented to the converter are substantially completely rejected.

The buck-boost converter 300 also includes a lamp return terminal 380. As was discussed above, the lamp return terminal may be used for determining a lamp voltage and/or lamp current of a lamp bulb being driven. It is noted that for the buck-boost converter 300, the lamp return signal terminal 380 is coupled with the same circuit node as the terminal 280, which is the terminal on which the DC voltage is received by the buck boost converter 300 from the passive PFC circuit 200. Therefore, in this particular configuration, additional circuitry and/or service logic (e.g., software) would be used to determine the lamp voltage and/or lamp current from the lamp return signal terminal 380 (e.g., in combination with other signals). For voltage measurement in the buck-boost converter 300, a simple voltage to current converter consisting of a resistor and PNP transistor operating as a current source may be used. In such an approach, the current may be measured with a differential amplifier that has a high common mode withstand voltage.

Flyback Converter

Figure 4:
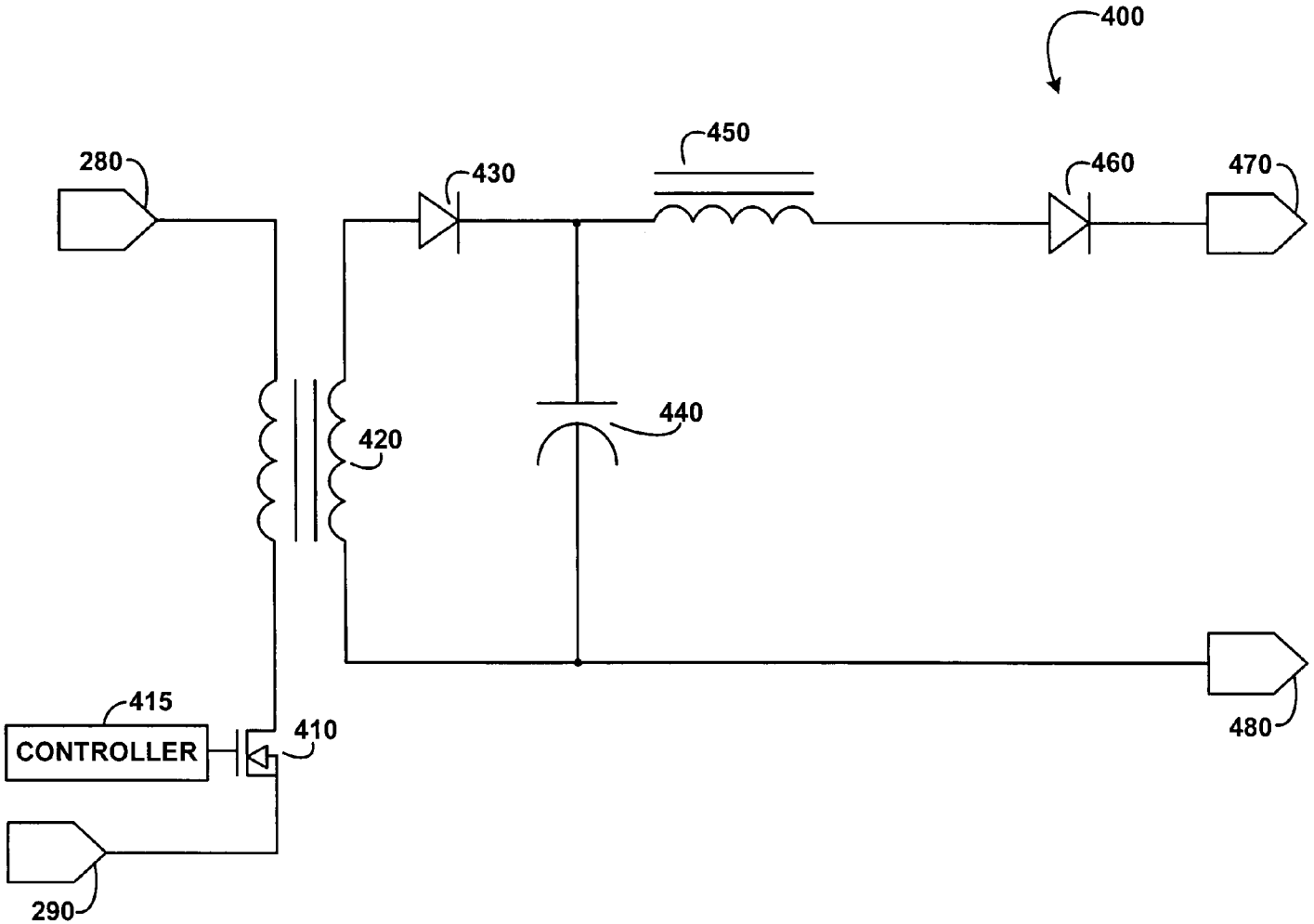
FIG. 4 is a schematic diagram of a flyback DC-DC converter that may be implemented in the circuit of FIG. 1.

Referring now to FIG. 4, a schematic diagram of a flyback DC-DC converter 400 is illustrated. As was described above with respect to the buck-boost converter 300, the output terminals 280 and 290 of the passive PFC circuit 200 act as input terminals for the flyback converter 400. The power delivered from the passive PFC circuit 200 is communicated to the flyback converter 400 via the terminals 280 and 290.

The flyback converter 400 operates in a somewhat similar fashion as the buck-boost converter 300. For example, the flyback converter 400 includes a n-type FET transistor 410 that is coupled with a controller 415 to control when the flyback converter 400 stores electrical energy from the passive PFC circuit 200 and when it delivers electrical energy to the lamp bulb and/or igniter. When the transistor 410 is on, electrical energy is stored in primary winding of the transformer 420. In contrast to the buck boost converter 300, electrical energy stored in the primary winding of the transformer 420 is transferred to the secondary winding of the transformer 420 and delivered when the transistor 410 is off and a sufficient potential exists across the secondary winding of the transformer 420 to forward bias diodes 430 and 460. Again, in similar fashion as the buck-boost converter 300, the flyback converter 400 includes an output capacitor 440 and an output inductor 450 for filtering the DC power delivered to an output terminal 470 of the flyback converter 400.

The flyback converter 400 operates, in conjunction with the passive PFC circuit 200, as a constant energy source in a substantially similar fashion as the buck-boost converter 300. For instance, the flyback converter 400 may be operated in discontinuous mode in a substantially similar fashion as was described above with respect to FIG. 3.

It will be appreciated that one difference in the operation of the flyback converter 400 and the buck-boost converter 300 in the lamp driver circuit 100 is that the flyback converter 400 has separate windings in the transformer 420 for charging (storing energy) and discharging (delivery energy). For the transformer 420, the primary winding is the charging winding and the secondary winding is the discharge winding. In comparison, the buck-boost converter 300 charges and discharges a single winding of the inductor 320. The separate charging and discharging windings of the transformer 420 allows the output reference for the flyback converter 400 to be selected independently from the internal operating voltages of the converter.

For instance, the flyback converter 400 also includes a lamp return signal terminal 480. In contrast to the lamp return signal terminal 380 of the buck-boost converter 300, the lamp return signal terminal 480 is isolated from the terminal 280 by the transformer 420. Therefore, for this particular configuration, lamp voltage and or lamp current may be directly determined based on the lamp return signal (e.g., in combination with other signals). In fact, the lamp return signal may be coupled with the same electrical ground reference that is used for the rest of the lamp driver circuit in which the flyback converter 400 is implemented.

EMI Filter Circuit

Figure 5:
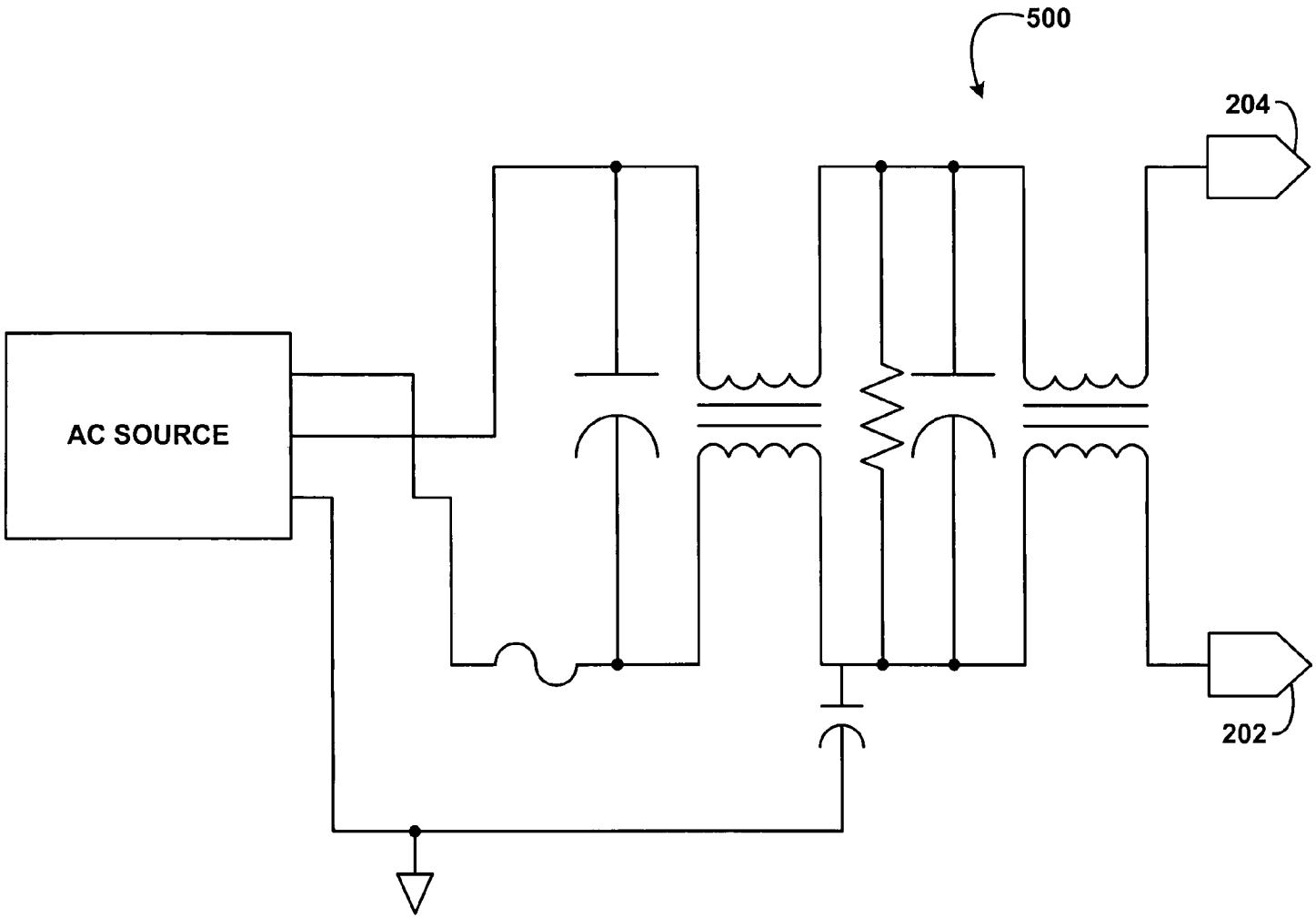
FIG. 5 is a schematic diagram of an electromagnetic interference filter that may be implemented in the circuit of FIG. 1.

FIG. 5 is a schematic drawing illustrating an EMI filter circuit 500 that may be implemented as the EMI filter 110 in the lamp driver circuit 100 shown in FIG. 1. The terminals 202 and 204 of the EMI filter circuit 500, in such an embodiment, are coupled with the passive PFC circuit 200 illustrated in FIG. 2. As was discussed above, such EMI filter circuits prevent voltage converter noise (e.g., high frequency noise) from contaminating an AC power supply line to which the lamp driver circuit 100 is connected. As an additional benefit, the EMI circuit 500 may also prevent noise present on the AC power supply line from being transmitted into such power converters, as illustrated in FIGS. 1-4, for example. Typically, circuits that include switching converters (such as the lamp driver circuit 100) include some type of EMI filtering, such as the EMI filter 500. Because such circuits are known, for purposes of brevity and clarity, the EMI filter circuit 500 will not be discussed in further detail here.

CONCLUSION

While a number of aspects and embodiments have been discussed above, after reading this disclosure, those of skill in the art will recognize certain modifications, permutations, additions and sub-combinations of those aspects and embodiments. It is therefore intended that the following appended claims and claims hereafter introduced are interpreted to include all such modifications, permutations, additions and sub-combinations as are within their true spirit and scope.

What is claimed is:

1. A lamp driver circuit comprising;

a passive power factor correction (PFC) circuit, wherein the passive PFC circuit, in operation, is coupled with an alternating-current (AC) power source;

a direct-current to direct-current flyback (DC-DC) power converter coupled with the passive PFC circuit, the flyback DC-DC power converter including a primary winding for storing energy and a secondary winding for discharging energy, wherein the flyback DC-DC power converter, in conjunction with the passive PFC circuit, operates as a constant energy converter so that ripple current is rejected; and a lamp circuit coupled with the DC-DC power converter.

2. The lamp driver circuit of claim 1, wherein the passive PFC circuit comprises a valley-fill circuit.

3. The lamp driver circuit of claim 1, wherein the lamp circuit comprises:

a lamp igniter circuit coupled with the DC-DC power converter; and a lamp bulb coupled with the lamp igniter.

4. The lamp driver circuit of claim 3, wherein the lamp bulb comprises a high-pressure, short-arc lamp bulb.

5. The lamp driver circuit of claim 1, further comprising:

an electromagnetic interference (EMI) filter coupled with the passive PFC circuit, wherein, in operation, the passive PFC circuit is coupled with the AC power source via the EMI filter.

6. The lamp driver circuit of claim 5, wherein the EMI filter comprises a resistive, inductive, capacitive circuit.

7. The lamp driver circuit of claim 1, wherein the valley-fill circuit comprises:

a bridge rectifier circuit coupled with the AC power source; and a charge storage and delivery circuit coupled with, and between, the bridge rectifier circuit and the flyback DC-DC power converter.

8. The lamp driver circuit of claim 7, wherein the charge storage and delivery circuit comprises:

a plurality of capacitors;

a plurality of diodes; and at least one resistor, wherein the plurality of capacitors, the plurality of diodes and the at least one resistor are arranged such that, in operation, the plurality of capacitors charge in series when a line voltage associated with the AC power source is greater than a threshold level and the plurality of capacitors discharge in parallel when the line voltage is less than the threshold level.

9. The lamp driver circuit of claim 8, wherein the threshold level is one-half of a nominal peak value of the line voltage.

10. A lamp driver circuit comprising:

an electromagnetic interference (EMI) filter, wherein the EMI filter, in operation, is coupled with an alternating-current (AC) power source;

a passive power factor correction (PFC) circuit coupled with the EMI filter;

a flyback direct-current to direct-current (DC-DC) power converter coupled with the passive PFC circuit, the flyback DC-DC power converter including a primary winding for storing energy and a secondary winding for discharging energy, wherein the DC-DC power converter, in conjunction with the passive PFC circuit, operates as a constant energy converter so that ripple current is rejected; and a lamp circuit coupled with the DC-DC power converter.

11. The lamp driver circuit of claim 10, wherein the passive PFC circuit comprises a valley fill circuit.

12. A lamp driver circuit comprising:

a passive power factor correction (PFC) circuit, wherein the passive PFC circuit, in operation, is coupled with an alternating-current (AC) power source;

a flyback direct-current to direct-current (DC-DC) power converter coupled with the passive PFC circuit, the flyback DC-DC power converter including a primary winding for storing energy and a secondary winding for discharging energy, wherein the DC-DC power converter, in conjunction with the passive PFC circuit, operates as a constant energy converter so that ripple current is rejected, and wherein the DC-DC converter operates discontinuously at a fixed frequency; and a lamp circuit coupled with the DC-DC power converter.

13. The lamp driver circuit of claim 12, wherein the passive PFC circuit, in operation:

rectifies an AC power signal generated by the AC power source to generate a rectified signal; and stores a substantially fixed amount of electrical energy and delivers that fixed amount of electrical energy to the DC-DC power converter each period of the AC power signal, wherein electrical energy is stored while the rectified signal is above a threshold level and the stored electrical energy is delivered to the DC-DC power converter while the rectified signal is below the threshold level.

14. The lamp driver circuit of claim 13, wherein the threshold level is approximately one-half a nominal peak value of a line voltage of the AC power source.

* * * * *